US006846123B1

(12) United States Patent
Bedford

(10) Patent No.: US 6,846,123 B1
(45) Date of Patent: Jan. 25, 2005

(54) COMBINED WRITING INSTRUMENT CLIP AND LETTER OPENER AND WRITING INSTRUMENT INCLUDING THE SAME

(76) Inventor: John N. Bedford, 18 Beach St., Coventry, RI (US) 02816

( * ) Notice: Subject to any disclaimer, the term of this patent is extended or adjusted under 35 U.S.C. 154(b) by 0 days.

(21) Appl. No.: 10/303,367

(22) Filed: Nov. 25, 2002

(51) Int. Cl.[7] ..... B43K 29/00; B43K 23/02; B26B 11/00

(52) U.S. Cl. ..... 401/195; 401/131; 7/158; D8/102; D19/56

(58) Field of Search ..... 401/131, 195, 401/52; 7/160, 158, 151, 161; D19/56; D8/98, 102

(56) References Cited

U.S. PATENT DOCUMENTS

| | | | | | |
|---|---|---|---|---|---|
| 471,283 | A | | 3/1892 | Volk et al. | |
| 1,215,010 | A | | 2/1917 | Erikson | |
| 1,374,882 | A | | 4/1921 | Curtis | |
| 1,447,841 | A | | 3/1923 | Fisher | |
| 1,538,641 | A | | 5/1925 | Liljeqvist | |
| 1,552,906 | A | | 9/1925 | Beadles | |
| 1,554,517 | A | | 9/1925 | O'Neill | |
| 1,592,203 | A | | 7/1926 | Hammalian | |
| 1,598,427 | A | | 8/1926 | Easton | |
| 1,690,980 | A | | 11/1928 | Johnson | |
| D139,558 | S | | 11/1944 | Vuksich | |
| D201,734 | S | * | 7/1965 | Derenski | D8/104 |
| 3,249,091 | A | | 5/1966 | Griesbach | |
| 4,081,907 | A | * | 4/1978 | Bosshold | 30/294 |
| D256,925 | S | * | 9/1980 | Postrehovsky-Axel | D19/47 |
| D421,889 | S | * | 3/2000 | Moore | D8/102 |
| 6,065,169 | A | | 5/2000 | Cheldin | |
| 6,163,910 | A | | 12/2000 | Cheldin | |

* cited by examiner

*Primary Examiner*—David J. Walczak
(74) *Attorney, Agent, or Firm*—Salter & Michaelson

(57) ABSTRACT

A combination clip and letter opener for a writing instrument, and a writing instrument including the same. The letter opener may include an integrally formed cutting edge or, alternatively, may include a razor-style cutting edge.

24 Claims, 7 Drawing Sheets

COMBINED WRITING INSTRUMENT CLIP AND LETTER OPENER AND WRITING INSTRUMENT INCLUDING THE SAME

BACKGROUND

1. Technical Field

The present invention relates to a combined writing instrument clip and letter opener and, in particular, to a writing instrument that includes such a combined writing instrument clip and letter opener.

2. Related Art

Writing instruments are often manufactured and sold in combination with other implements that frequently may be convenient to have and use when an individual is writing. Examples of such implements include erasers, caps, clips, letter openers, staple removers, and the like. The patent literature includes numerous examples of combination writing instrument and letter openers.

Some combination writing instrument and letter openers include retractable or folding mechanisms. For example, U.S. Pat. No. 1,598,427 to Easton and U.S. Pat. No. 1,447,841 to Fisher disclose writing instruments with a retractable blade. The effectiveness of such folding or retractable-type letter openers may be short-lived because the retracting mechanism often does not possess sufficient strength to effectually open the mail and/or the mechanism may easily break.

Other combination writing instruments and letter openers include blade-type letter openers. For example, U.S. Pat. No. 1,538,641 to Liljeqvist discloses a clip for a pencil that includes a folding or pivoting blade. In general, blade-type letter openers have a tendency to puncture or spear the user's skin or clothing when in use or when stored in, for example, a pocket.

There are also examples of writing instruments that include letter openers in which the cutting edge, is recessed or positioned underneath part of the writing instrument. For example, U.S. Pat. No. 471,238 to Volk et al. discloses a writing instrument clip that includes a cutter positioned underneath a clip. U.S. Pat. No. 1,374,882 to Curtis discloses a letter opener with the cutting edge directed upwardly toward the cap of a pen or pencil. U.S. Pat. No. 6,065,169 to Cheldin discloses a letter opener in which the blade of the letter opener is directed downwardly toward the writing end of the instrument. U.S. Pat. No. 6,163,910 to Cheldin discloses a letter opener in which the cutting blade is directed upwardly opposite the writing tip of the writing instrument. Even though the cutting edge is recessed, the tip of the letter opener may tear fabric or puncture a user's skin, making them undesirable to use.

Thus, there remains a need in the art for an improved combination letter opener and writing instrument.

SUMMARY

The present invention overcomes the foregoing problems by providing a combined writing implement clip and letter opener in which the clip portion includes a letter opener, which may include a blade. The letter opener portion of the clip member is defined by a channel that has an open end on one side of the clip and a closed end adjacent the base of the clip. In some embodiments, a cutting blade may be mounted in the closed end of the channel.

In one embodiment, the disclosure is directed to a writing instrument including a clip member and a letter opener. The writing instrument includes a body having a longitudinal axis and a clip member spaced apart from and supported on the body. The clip member includes front and rear surfaces and an outer edge, and a channel having a first end opening at the outer edge and a second, closed end. The writing instrument also includes a cutting member having a cutting edge positioned at the closed end of the channel. The cutting edge is spaced apart from the front and rear surfaces of the clip member and is positioned in angled relation to the longitudinal axis of the body.

In another embodiment, the writing instrument includes a body having a longitudinal axis and a clip member having an outer edge. The clip member is spaced apart from and supported on the body and includes a channel having a first end opening at the outer edge and a second, closed end. A blade member is positioned at the closed end of the channel, which blade member includes a cutting edge positioned in angled relation to the longitudinal axis of the body.

In yet another embodiment, the writing instrument includes a body having a longitudinal axis and a writing end. The writing instrument includes a clip member spaced apart from and supported on the body. The clip member includes front and rear surfaces and an outer edge, and a channel having a first end opening at the outer edge and a second, closed end. The channel extends angularly from the outer edge to define a convergent tip facing away from the writing end. A cutting member includes a cutting edge positioned at the closed end of the channel and facing away from the writing end and forming an obtuse angle with the angle of the channel. The cutting edge is spaced apart from the front and rear surfaces of the clip member and is positioned in angled relation to the longitudinal axis of the body.

The foregoing and other objects, features and advantages of the disclosure will be apparent from the following more particular description of preferred embodiments of the disclosure, as illustrated in the accompanying drawings in which like reference characters refer to the same parts throughout the different views. The drawings are not necessarily to scale, emphasis instead being placed upon illustrating the principles of the disclosure. The principles and features of this disclosure may be employed in varied and numerous embodiments without departing from the scope of the disclosure.

BRIEF DESCRIPTION OF THE DRAWINGS

It should be understood that the drawings are provided for the purpose of illustration only and are not intended to define the limits of the disclosure. In the drawings.

DETAILED DESCRIPTION OF THE PREFERRED EMBODIMENTS

The present invention is directed to a clip member that includes a letter opener and that may be an integral part of a writing instrument, or may be included in a cap for a writing instrument. The clip member may be separate from and attached to, or integrally formed with the writing instrument. The clip member includes a channel having a closed end in which a cutting edge is positioned. When a writing instrument with the present clip member is positioned in, for example, a pocket, the cutting edge is spaced from the fabric so that it does not tear or penetrate the fabric.

Figure 1:
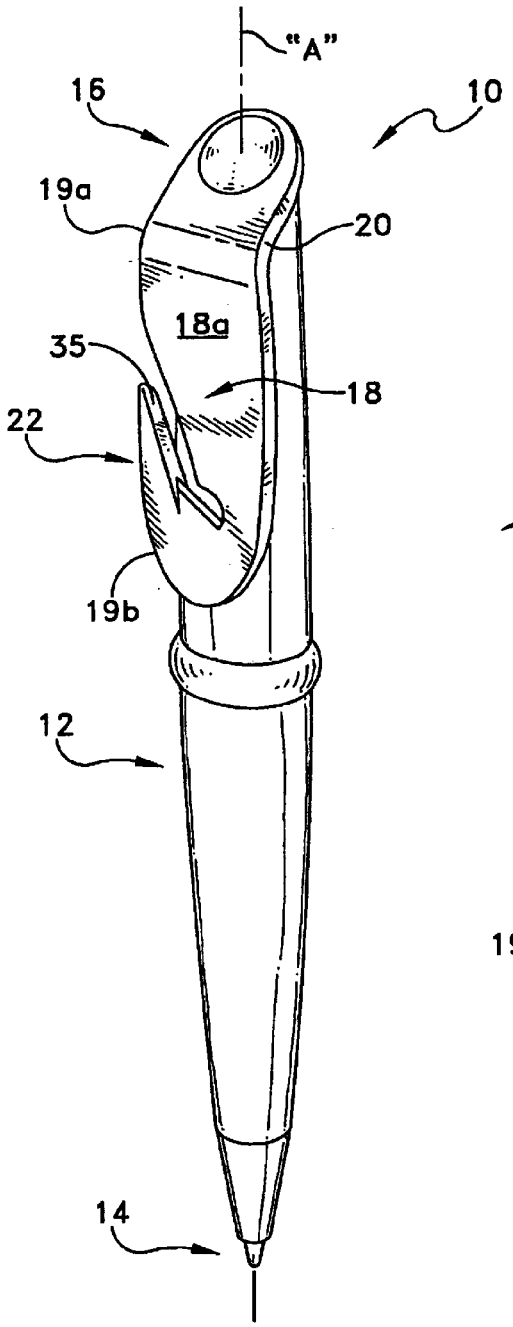
FIG. 1 is a perspective view of an exemplary writing instrument that includes a combination clip and letter opener according to the present invention.
Figure 2:
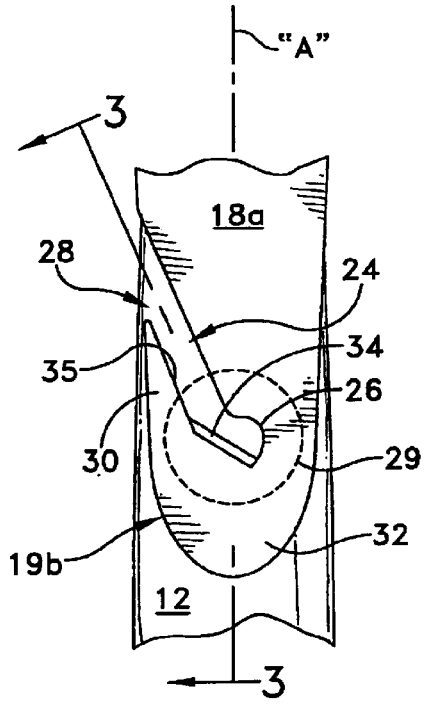
FIG. 2 is an enlarged fragmentary elevational view of the clip portion of the writing instrument shown in FIG. 1.
Figure 3:
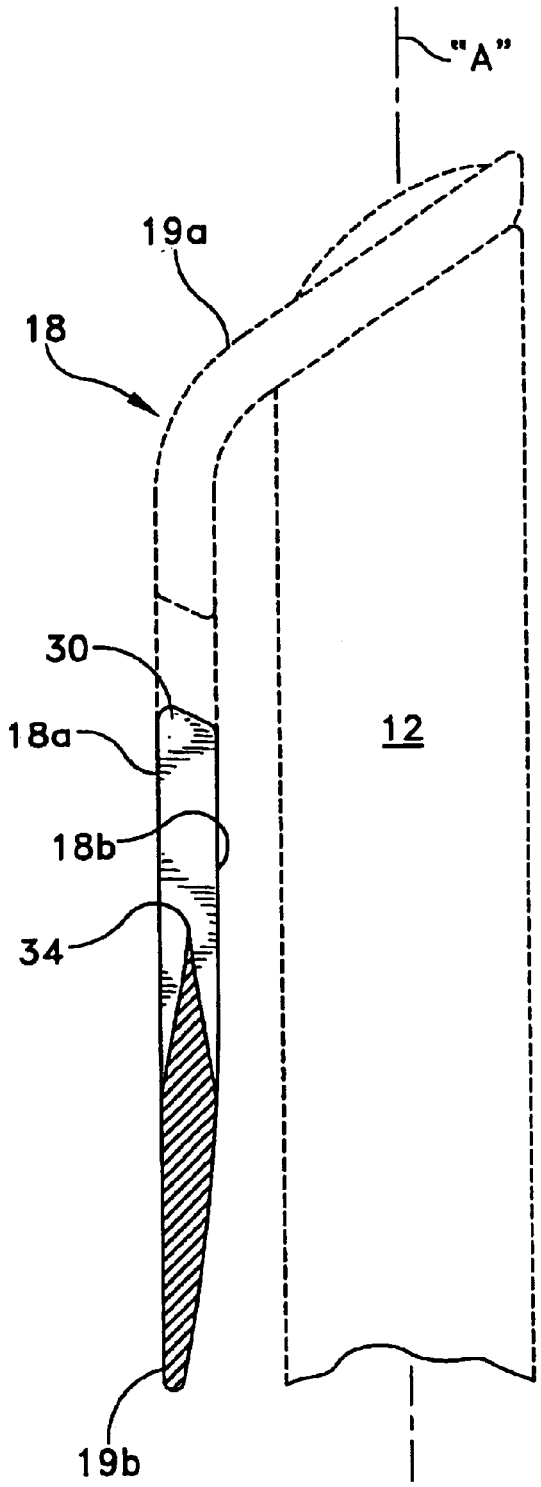
FIG. 3 is a cross-sectional view of the clip portion of the writing instrument taken on line 3—3 in FIG. 2.
Figure 9:
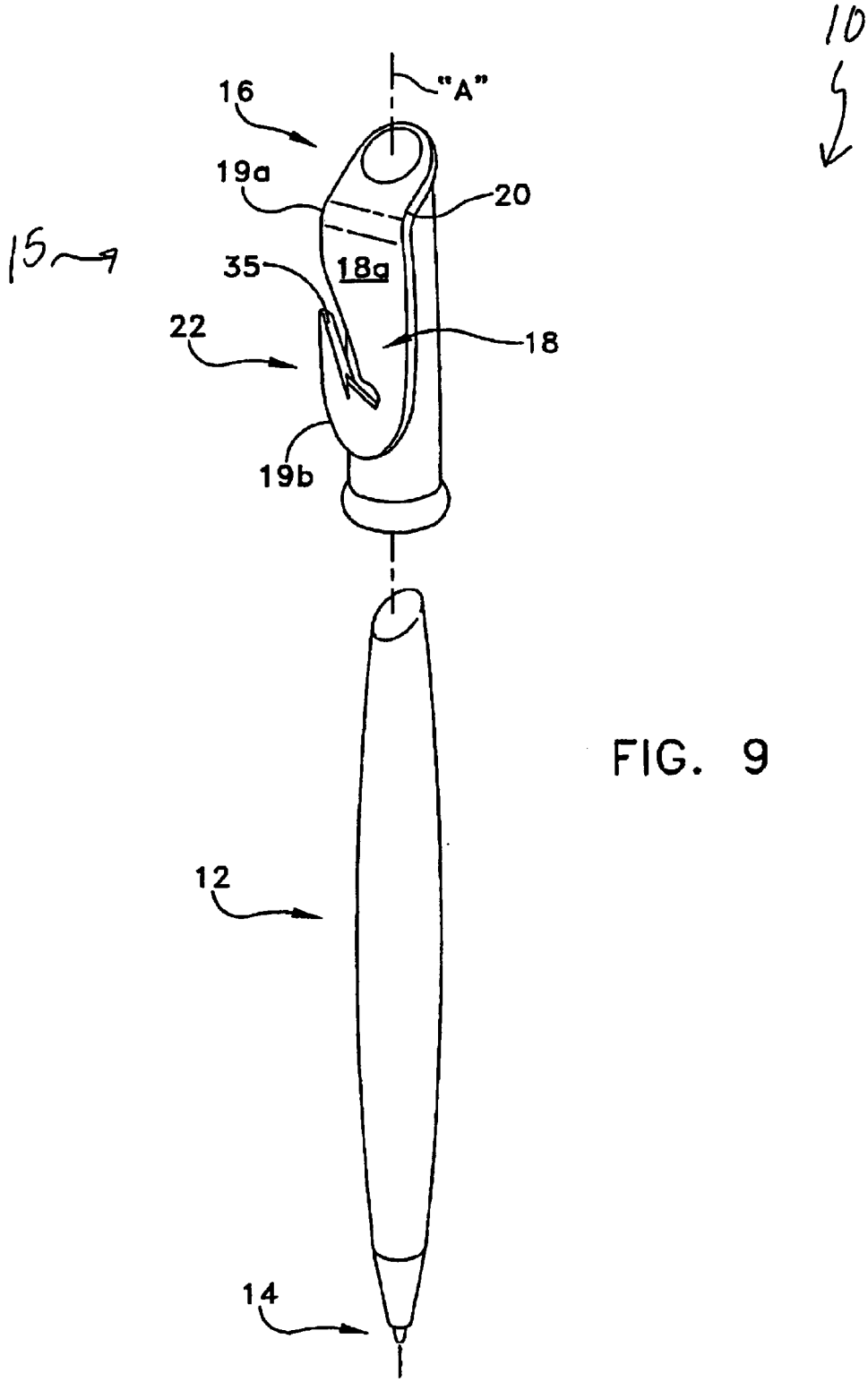
FIG. 9 is a perspective view of another embodiment of an exemplary writing instrument in which the combination clip and letter opener is positioned on a cap for the writing instrument.

One embodiment of the present writing instrument is shown in FIGS. 1–3 when taken together. As shown, writing instrument 10 includes a generally longitudinal body 12 having a first, writing end 14 and a second end 16 opposite writing end 14. In preferred embodiments, the body may be cylindrical. A clip member indicated generally at 18 may be supported on or attached to writing instrument 10 by any conventional means. Clip member 18 has upper and lower ends 19*a* and 19*b* respectively, and an outer edge 20, and in the present embodiment is mounted to instrument 10 at second end 16. Alternatively, clip member 18 may be mounted on a cap 15 (as shown in FIG. 9) for a writing instrument. Clip member 18 includes front and rear surfaces 18*a* and 18*b* respectively, having a peripheral outer edge 20. In the present embodiment, opposing surfaces 18*a,b* are substantially planar and substantially parallel to one another. Also in the present embodiment, opposing surfaces 18*a,b* are substantially perpendicular to a plane intersecting axis "A" of writing instrument 10.

Clip member 18 includes a letter opener portion indicated generally at 22, and which is defined by a channel 24 that extends from a closed end 26 at an inner region 29 of clip member 18 to an open end 28 at the outer edge 20 of clip member 18. Channel 24 is preferably positioned at an angle with respect to the longitudinal axis "A" of the writing instrument 10, as shown in FIGS. 1 and 2.

Letter opener 22 includes a convergent tip portion 30 proximate open end 28 of channel 24, and a relatively wide portion 32 proximate closed end 26 of channel 24. Preferably, the tip of the letter opener faces away from the writing end of the instrument. Preferably, outer edge 20 is rounded at tip portion 30 and at lower end 19*b*, which prevents catching or tearing of fabric on which instrument 10 may be mounted.

Closed end 26 of channel 24 includes a cutting edge 34, which is located intermediate the surfaces 18*a,b* of clip member 18. The orientation of cutting edge 34 ensures that it will not inadvertently catch or tear paper or fabric when in storage or use. Cutting edge 34 also is preferably positioned at an angle with respect to the longitudinal axis "A" of the writing instrument 10 and also defines an obtuse angle with the edge 35 of channel 24 so that the cutting edge faces away from a writing end of the writing instrument in the embodiment of FIGS. 1–5, cutting edge 34 is integrally formed with clip member 18, but it may be a separate element, as discussed below.

The clip member may be formed from any suitable material including, but not limited to, metal, plastic, and the like. Similarly, when combined with a writing instrument or a cap for a writing instrument, the cap and the writing instrument may be formed from any of the foregoing materials. The clip member may be combined with any type of writing instrument such as a pen, pencil, marker, etc.

Figure 4:
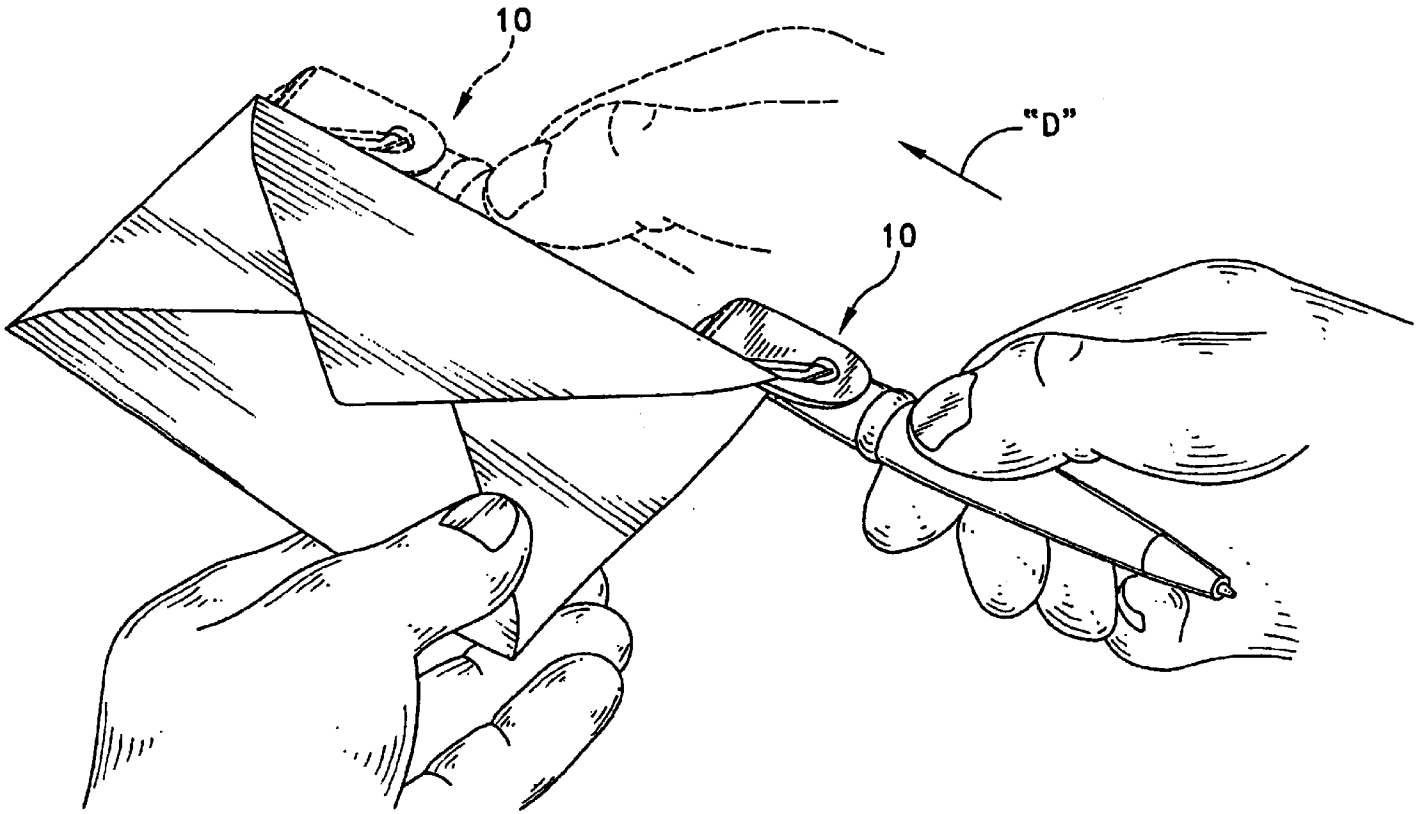
FIG. 4 illustrates the method of using the combination clip and letter opener of the present disclosure to open a letter.

In use, as shown in FIG. 4, a user may grasp writing instrument 10 to insert tip portion 30 of letter opener 22 into an end of the sealed flap of an envelope while maintaining the longitudinal axis of the writing instrument in substantially parallel relation to the flap edge of the envelope. The user then may slide the writing instrument in the direction of arrow "D" until cutting edge 34 engages the flap of the envelope. Once cutting edge 34 engages the flap of the envelope, the user simply slides the writing instrument in the direction of arrow "D" with sufficient force to slit the flap of the envelope at the fold of the envelope from one end to the other. The particular angulation of cutting edge 34 relative to the angulation of channel 24 facilitates effective cutting or slitting of the envelope along the fold line of the envelope flap.

Figure 5:
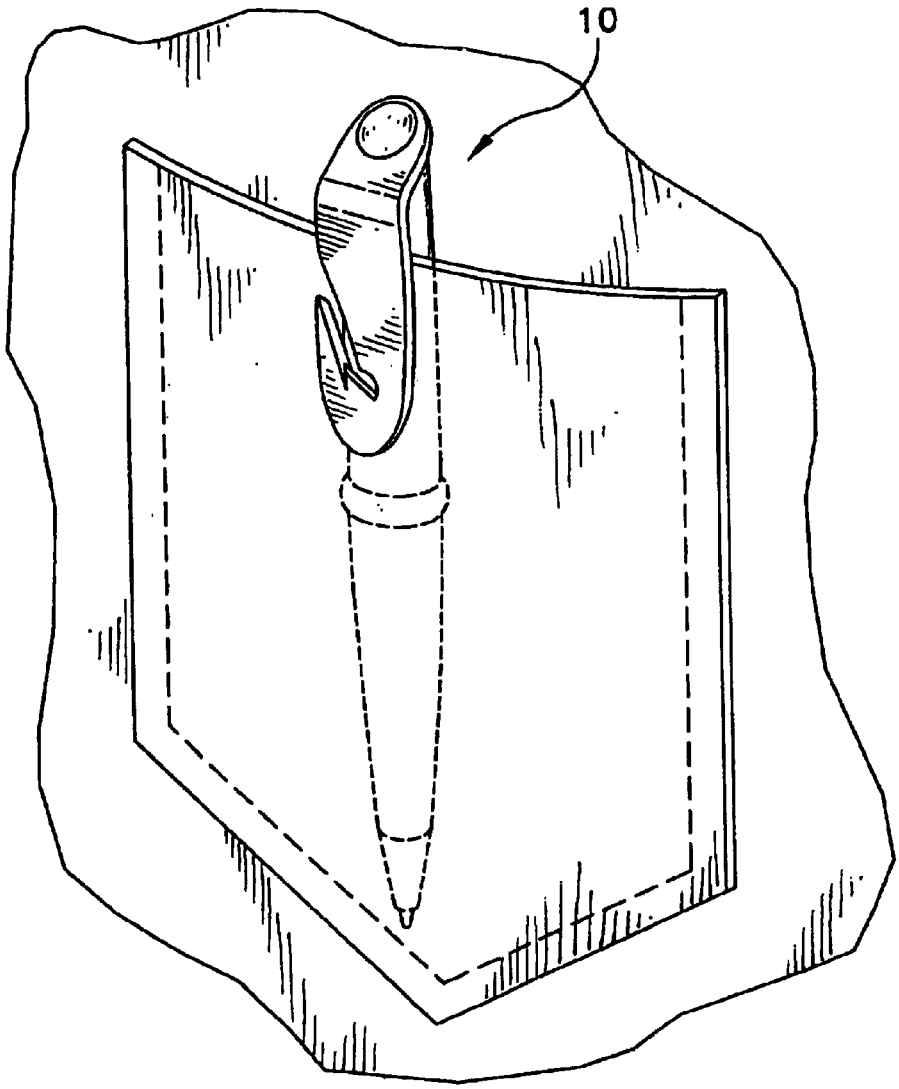
FIG. 5 illustrates the writing instrument stored into a pocket.

When mounted in the pocket of a garment, for example, as shown in FIG. 5, cutting edge 34 is oriented to remain substantially parallel to the fabric of the garment and spaced therefrom so that cutting edge 34 will not engage and possibly tear the fabric of the user's garment. In addition, the rounded edges of the tip portion 30 and lower edge 19*b* of clip member 18 ensure that the writing instrument may be removed and inserted into a garment for storage without injury to the user or damage to the fabric of a garment.

Figure 6:
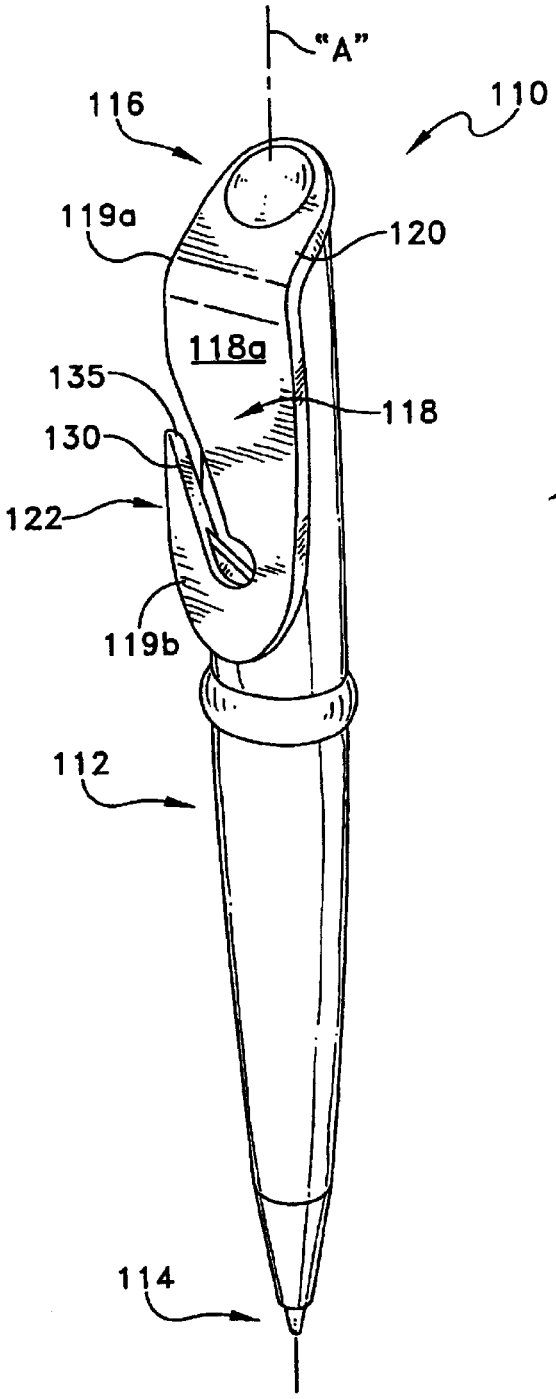
FIG. 6 is a perspective view of a modified form of my invention.
Figure 7:
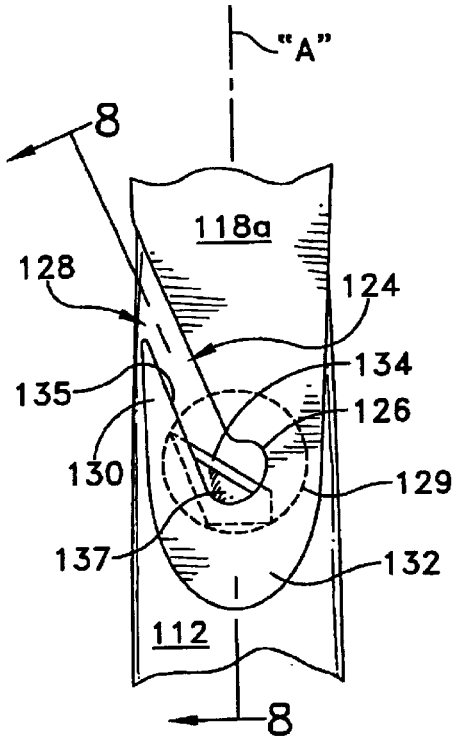
FIG. 7 is an enlarged fragmentary elevational view of the clip portion of the writing instrument shown in FIG. 6.
Figure 8:
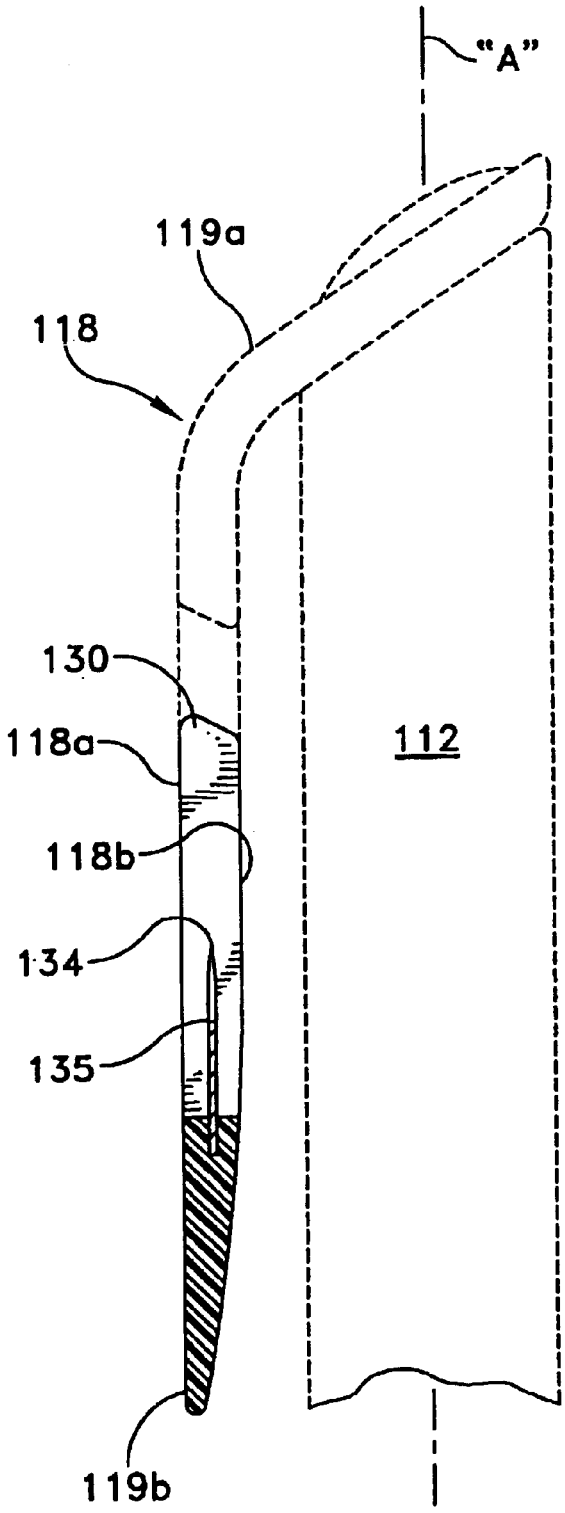
FIG. 8 is a cross-sectional view of the clip portion of the writing instrument taken on line 8—8 in FIG. 7.

Another exemplary writing instrument is shown in FIGS. 6–8 when taken together. As shown, writing instrument 110 has generally the same construction as in the previous embodiment, wherein like elements are preceded by the number "1." Thus, writing instrument 110 includes a generally longitudinal body 112 and a clip member indicated generally at 118 having upper and lower ends 119*a,b*, outer edge 120, and opposing surfaces 118*a,b* bounded by outer edge 120.

As in the previous embodiment, opposing surfaces 118*a,b* are substantially planar and substantially parallel to one another and substantially perpendicular to a plane intersecting axis "A" of writing instrument 110.

Clip member 118 includes a letter opener portion indicated generally at 122, and which is defined by a channel 124 that extends from a closed end 126 at an inner region 129 of clip member 118 to an open end 128 at the outer edge 120 of clip member 118. Channel 124 is preferably positioned at an angle with respect to the longitudinal axis "A" of the writing instrument 110, as in the previous embodiment.

Letter opener 122 includes a convergent tip portion 130 proximate open end 128 of channel 124 and a relatively wide portion 132 proximate closed end 126 of channel 124. Preferably, outer edge 120 is rounded at tip portion 130 and at lower end 119*b*, which prevents catching or tearing of fabric on which the instrument may be mounted.

Closed end 126 of channel 124 includes a cutting blade 137 having a cutting edge 134. Cutting blade 137 is received in a recess (not illustrated) so that it is spaced intermediate the surfaces 118*a,b* of clip member 118. Cutting blade 137 may be friction fitted into the recess or fixed in place by, for example, glue, rivets, screws, and the like or it may even be molded in position during molding of clip member 118. Preferably, cutting blade 137 and thus, cutting edge 134, are positioned substantially parallel to opposing surfaces 118*a,b* and substantially perpendicular to a plane intersecting axis A so that they will not inadvertently catch or tear paper or fabric when in storage or use. As in the previous embodiment, cutting edge 134 also may be positioned at an angle with respect to the longitudinal axis "A" of the writing instrument 10, and specifically forms an obtuse angle with edge 135 of channel 124.

The material from which the clip member, writing instrument, and cap may be formed is the same as in the previous embodiment. The present clip member may be combined with any type of writing instrument such as a pen, pencil, marker, etc:

While this disclosure has been particularly shown and described with references to preferred embodiments thereof, it will be understood by those skilled in the art that various changes in form and details may be made therein without departing from the spirit and scope of the disclosure as defined by the appended claims.

What is claimed is:

1. A writing instrument including a clip member and a letter opener, comprising:

a body having a longitudinal axis;

the clip member having front and rear surfaces and a channel disposed therethrough, the channel having a first end opening at an outer edge and extending to a second, closed end, the clip member being supported on the body at an upper end thereof and defining a space between the body and the rear surface and extending substantially from the upper end to a lower end of the clip member, and being adapted to receive an article of clothing therein; and a cutting member having a cutting edge positioned at the closed end of the channel, the cutting edge being spaced apart from the front and rear surfaces of the clip member and being positioned in angled relation to the longitudinal axis of the body;

wherein the clip member is constructed and arranged to support the writing instrument on the article of clothing when the article of clothing is received in the space between the body and the rear surface of the clip member such that the article of clothing extends substantially to the upper end.

2. The writing instrument of claim 1, wherein the cutting member is integral with the clip member.

3. The writing instrument of claim 1, wherein the cutting edge faces away from a writing end of the writing instrument.

4. The writing instrument of claim 1, wherein the cutting member further comprises a blade member positioned within the closed end.

5. The writing instrument of claim 4, wherein an edge of the blade member is the cutting edge.

6. The writing instrument of claim 4, wherein the closed end of the channel includes a recessed region for receiving the blade therein.

7. The writing instrument of claim 1, wherein the front and rear surfaces are substantially planar and substantially parallel.

8. The writing instrument of claim 1, wherein the body is substantially cylindrical.

9. The writing instrument of claim 1, wherein the channel extends angularly from the outer edge so as to define a convergent tip.

10. The writing instrument of claim 9, wherein the cutting edge forms an obtuse angle with the angle of the channel.

11. The writing instrument of claim 9, wherein the tip of the letter opener faces away from the writing end of the instrument.

12. The writing instrument of claim 1, further comprising a cap for the writing instrument, and wherein the clip member depends downwardly from the cap for the writing instrument.

13. The writing instrument of claim 12, wherein the clip member is connected to the cap.

14. The writing instrument of claim 1, wherein the clip member is connected to body.

15. A writing instrument including a clip member and a letter opener, comprising:

a body having a longitudinal axis and a writing end;

a clip member spaced apart from and supported on the body, the clip member having front and rear surfaces and an outer edge, a channel having a first end opening at the outer edge and a second, closed end, the channel extending angularly from the outer edge to define a convergent tip facing away from the writing end; and a cutting member having a cutting edge positioned at the closed end of the channel and facing away from the writing end and forming an obtuse angle with the angle of the channel, the cutting edge being spaced apart from the front and rear surfaces of the clip member and being positioned in angled relation to the longitudinal axis of the body; and an article of clothing sandwiched between the body and the rear surface of the clip member in order to support the writing instrument on the article of clothing.

16. The writing instrument of claim 15, wherein the cutting member is integral with the clip member.

17. The writing instrument of claim 15, wherein the cutting member further comprises a blade member positioned within the closed end.

18. The writing instrument of claim 17, wherein an edge of the blade member is the cutting edge.

19. The writing instrument of claim 17, wherein the closed end of the channel includes a recessed region for receiving the blade therein.

20. The writing instrument of claim 15, wherein the front and rear surfaces are substantially planar and substantially parallel.

21. The writing instrument of claim 15, wherein the body is substantially cylindrical.

22. The writing instrument of claim 15, further comprising a cap for the writing instrument, and wherein the clip member depends downwardly from the cap for the writing instrument.

23. The writing instrument of claim 22, wherein the clip member is connected to the cap.

24. The writing instrument of claim 15, wherein the clip member is connected to body.

* * * * *